US007708075B2

(12) United States Patent
Lake et al.

(10) Patent No.: US 7,708,075 B2
(45) Date of Patent: May 4, 2010

(54) SYSTEM AND METHOD FOR INJECTING A CHEMICAL DOWNHOLE OF A TUBING RETRIEVABLE CAPILLARY BYPASS SAFETY VALVE

(75) Inventors: Gary B. Lake, Houston, TX (US); Kerry J. Broussard, Broussard, LA (US); Richard Patterson, Houston, TX (US); Keith M. Lalumia, Lafayette, LA (US); Richard W. Whalen, Sr., Broussard, LA (US)

(73) Assignee: Baker Hughes Incorporated, Houston, TX (US)

( * ) Notice: Subject to any disclaimer, the term of this patent is extended or adjusted under 35 U.S.C. 154(b) by 194 days.

(21) Appl. No.: 11/925,376

(22) Filed: Oct. 26, 2007

(65) Prior Publication Data

US 2009/0107683 A1 Apr. 30, 2009

(51) Int. Cl.
*E21B 34/00* (2006.01)

(52) U.S. Cl. ..... 166/375; 166/310; 166/305.1

(58) Field of Classification Search ..... 66/310, 66/375, 305.1; 166/310, 375, 305.1
See application file for complete search history.

(56) References Cited

U.S. PATENT DOCUMENTS

| | | | | |
|---|---|---|---|---|
| 4,605,063 | A | 8/1986 | Ross | |
| 4,660,647 | A | 4/1987 | Richart | |
| 5,117,913 | A | 6/1992 | Themig | |
| 6,851,478 | B2 * | 2/2005 | Cornelssen et al. | 166/368 |
| 7,082,996 | B2 | 8/2006 | Smith et al. | |
| 7,198,099 | B2 | 4/2007 | Lugtmeier et al. | |
| 7,219,742 | B2 | 5/2007 | Smith et al. | |
| 2004/0163805 | A1 | 8/2004 | Smith et al. | |
| 2005/0098210 | A1 * | 5/2005 | Strattan et al. | 137/70 |
| 2006/0021750 | A1 | 2/2006 | Lugtmeier et al. | |
| 2006/0169459 | A1 | 8/2006 | Smith et al. | |
| 2006/0231256 | A1 | 10/2006 | Rivas et al. | |
| 2007/0187114 | A1 | 8/2007 | Smith et al. | |
| 2008/0169106 | A1 * | 7/2008 | Hill et al. | 166/375 |
| 2008/0271893 | A1 * | 11/2008 | Hill et al. | 166/305.1 |
| 2008/0308268 | A1 * | 12/2008 | Hill et al. | 166/129 |

FOREIGN PATENT DOCUMENTS

| | | |
|---|---|---|
| CA | 2244593 | 2/2000 |

(Continued)

OTHER PUBLICATIONS

"T-Series Tubing Retrievable Surface Controlled Subsurface Safety Valve Product Family Nos. Listed in Chart." Baker Oil Tool Product Report: Cased Hole Completion Systems. May 2003.

(Continued)

*Primary Examiner*—William P Neuder
*Assistant Examiner*—Nicole A Coy
(74) *Attorney, Agent, or Firm*—Cantor Colburn LLP

(57) ABSTRACT

A chemical injection system includes a TRSV; a communication nipple in operable communication with the TRSV and positioned relative to the TRSV to be downhole of a flapper closure mechanism thereof when installed in a wellbore; a chemical injection line in fluid communication with the communication nipple; and a capillary sleeve receivable at the communication nipple and configured to sealingly convey fluid from the communication nipple to a remote location without affecting operation of the TRSV and method.

12 Claims, 3 Drawing Sheets

FOREIGN PATENT DOCUMENTS

| | | | |
|---|---|---|---|
| WO | 2006034214 | | 3/2006 |
| WO | 2006048629 | | 5/2006 |
| WO | WO2006/069372 | * | 6/2006 |

OTHER PUBLICATIONS

"Model LP, HP, and QP Communications Nipples Product Family Nos. H82415 (LP), H82406 (HP), and H82016/H82409 (QP)." Baker Oil Tool Product Report: Cased Hole Completion Systems. May 2003.

"Puncture Communication Tool Product Family No. H82281." Baker Oil Tool Product Report: Cased Hole Completion Systems. Sep. 2003.

"Pilot capillary Surfactant-Injection System in the San Juan Basin." JPT Online. Retrieved on Oct. 26, 2007 from: http://www.spe.org/spe-app/spe/jpt/2006/05/artificial_lift2_94293.htm. May 2006.

"Drilling and Completion- Capillary String Added to Production Bow." Oil Online. Retrieved on Oct. 29, 2007 from: http://www.oilonline.com/news/features/aog/20060510.Drilling.21164.asp. May 10, 2006.

"InjectSafe Sub-Surface Safety Valve System." BJ Services Company. Retrieved on Oct. 29, 2007 from http://www.bjservices.com/website/Completions.nsf/0/9AE31A8A85B3F628862571F6007A8AEF/$file/InjectSafe+Sub-Surface+SVS.pdf. Sep. 14, 2006.

"Drilling and Production: Developing Downhole Valve Technology." Offshore Magazine. Retrieved on Oct. 26, 2007 from: http://www.offshore-mag.com/articles/save_screen.cfm?ARTICLE_ID=306980. Sep. 2007.

"BJ's Dyna-Coil Injection Systems Enhance Production." Rigzone.com. Retrieved on Oct. 26, 2007 from: http://www.rigzone.com/news/article.asp?a_id=49923. Sep. 7, 2007.

"Resurrecting a Low-Pressure Gas Well Offshore: Through-Tubing Foamer Injection via a Capillary Tubing System and a Specialized WRSCSSV." SPE 110086; SPE Annual Technical Conference and Exhibition. Anaheim California, Nov. 11-14 2007.

"Control Valve Saves Dead Well." E&P Magazine Online. Retrieved on Oct. 26, 2007 from: http://eandp.info/area/drill/505.htm. Copyright 2007.

"Model BCCI-1 Chemical Injection Valve Product Family No. H86103." Baker Oil Tools Product Report; Chemical Injection Valves.

"Model BCCICK (-DC, -HP, -DCHP) Chemical Injection Check Valve Product No. H86120." Baker Oil Tools Product Report; Chemical Injection Check Valves.

"Caledyne Announces Torus Safety Valve Test Success." Oil & Gas Network Online. Retrieved on Oct. 29, 2007 from: http://www.oilgas.net/app/dynarea/article_pdf/2.html. Oct. 2007.

International Search Report and Written Opinion, Mailed Jul. 20, 2009, International Appln No. PCT/US2008/080676; Written Opinion 7 Pages; International Search Report 3 Pages.

* cited by examiner

SYSTEM AND METHOD FOR INJECTING A CHEMICAL DOWNHOLE OF A TUBING RETRIEVABLE CAPILLARY BYPASS SAFETY VALVE

BACKGROUND

In the hydrocarbon recovery industry, it is often desirable to chemically treat specific portions of well systems to, for example, enhance production, reduce corrosion of production components, reduce or avoid the buildup of problematic substances such as scale, paraffin, hydrates, etc. In some well systems, the application of chemicals to a target area can be a relatively straightforward process with little obstructive conditions or componentry to cause concern or consternation. In other well systems, however, chemical injection, as it is vernacularly termed, is less selectively achieved. In one example, well systems that are legally required to employ Surface Controlled Subsurface Safety Valves (SCSSV) present a difficult obstacle to chemical injection. The operator is faced with either having a fixed location for chemical injection, installed at the time that the TRSV is installed or a system that impacts functionality of the TRSV. Since running a tool through the SCSSV would create a safety issue by holding its closure mechanism open, considerable modification and complexity will be required to maintain a failsafe operation and protection of the well, in order to maintain compliance with applicable law. Since increased cost and complexity are always parameters of well operation to be avoided, the art is always receptive to alternative methods and apparatus that eschew such parameters.

SUMMARY

A chemical injection system includes a TRSV; a communication nipple in operable communication with the TRSV and positioned relative to the TRSV to be downhole of a flapper closure mechanism thereof when installed in a wellbore; a chemical injection line in fluid communication with the communication nipple; and a capillary sleeve receivable at the communication nipple and configured to sealingly convey fluid from the communication nipple to a remote location without affecting operation of the TRSV.

A method for injecting a chemical to an area of a wellbore downhole of a TRSV includes running a PCT to a preinstalled communication nipple downhole of the flapper closure mechanism of the TRSV; creating an opening in the communication nipple with the PCT thereby fluidly communicating a chemical injection line with an inside dimension of the communication nipple; and sealing a capillary sleeve with the inside dimension of the communication nipple at the opening.

BRIEF DESCRIPTION OF THE DRAWINGS

Referring now to the drawings wherein like elements are numbered alike in the several Figures.

DETAILED DESCRIPTION

Figure 1:
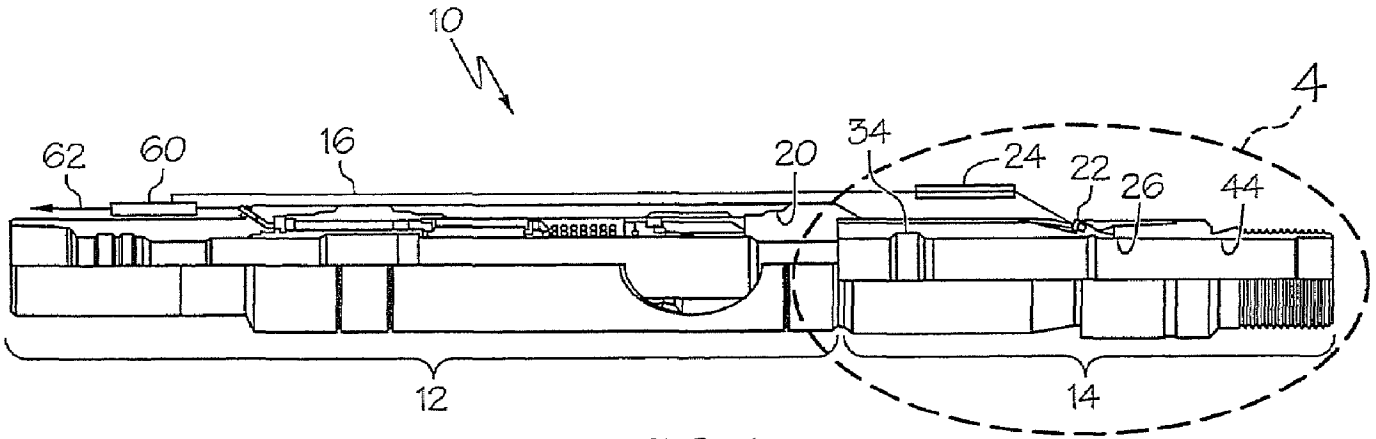
FIG. 1 is a schematic quarter-sectional view of a Tubing Retrievable Surface Controlled Subsurface Safety Valve (TR-SCSSV or TRSV) and a communication nipple in accordance with an embodiment of the invention.
Figure 2:
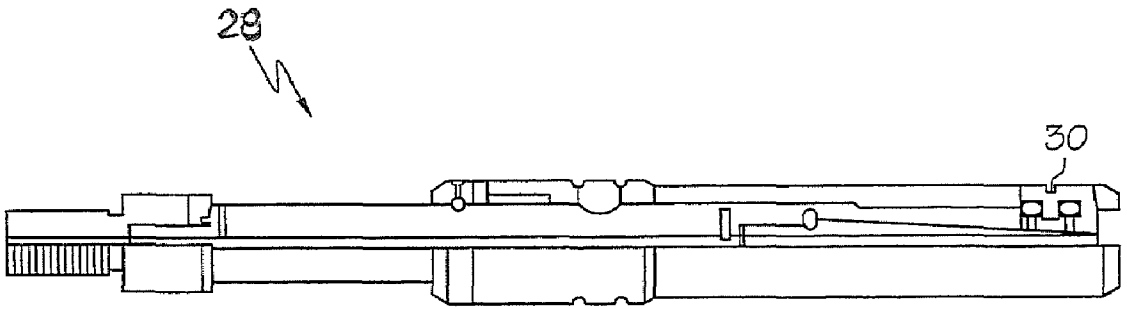
FIG. 2 (PRIOR ART)
FIG. 2 is a quarter-section view of a Puncture Communication Tool (PCT) of the prior art.
Figure 3:
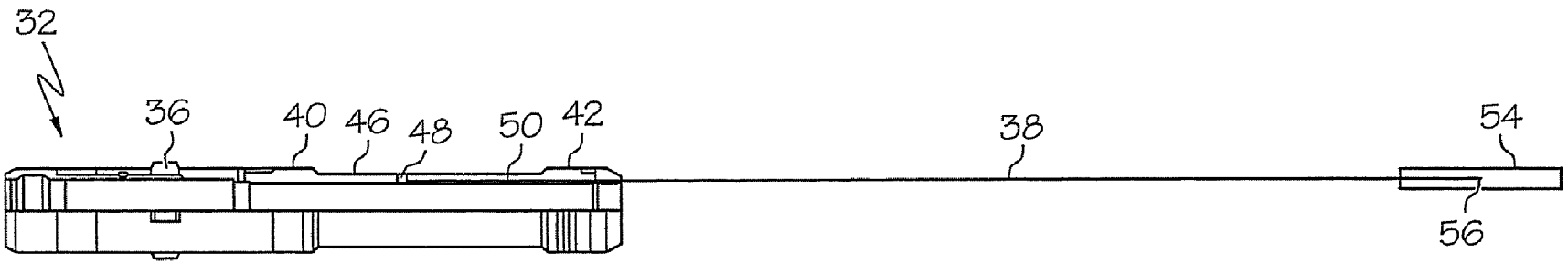
FIG. 3 is a quarter section view of a capillary sleeve in accordance with an embodiment of the invention.

Referring to FIGS. 1, 2, and 3, a system 10 is illustrated that together facilitates chemical injection downhole of an SCSSV while retaining full function of the SCSSV. In one embodiment, the SCSSV is a TRSV as illustrated. Referring to FIG. 1, a TRSV 12 is illustrated connected to a communication nipple 14. The TRSV is commercially available, for example, from Baker Oil Tools, Houston, Tex. under Product Number H825603800 and therefore requires no specific discussion of its components or operation. It is to be appreciated that the chemical injection line is most commonly run at the outside dimension of the TRSV and is fixed there by known methods.

The TRSV is threadedly connected at thread 20 to a tubing spaceout string (not shown) or directly to the communication nipple 14. Communication nipple 14 may be of a commercially available type sold, for example, by Baker Oil Tools, Houston Tex. under the product number H824063810, for example. It is to be appreciated that the chemical injection line 16 is fluidly connected to the nipple 14 at connection site 22 and in one embodiment, as illustrated, only after passing through a Chemical Injection Valve 24 (CIV), which is a check valve configuration. An appropriate CIV is, for example, commercially available from Baker Oil Tools Houston Tex. under product number H861039996. Connection site 22 is fluidly connected to a thin walled portion 26 of the nipple 14 that is intended to receive a puncture device from a subsequently run PCT 28 (for example, commercially available from Baker Oil Tools Houston Tex. under product number H822813815), see FIG. 3. It is to be appreciated that several types of puncture devices 30 are available each being contemplated for use in this system.

Once the PCT 28 is run to position and operated, the chemical injection line is open at opening 27 and will flow chemical into the communication nipple 14 (the flow path of the produced hydrocarbons). As the provision of chemical at this location does not necessarily improve the production process, it is desirable to quickly trip the PCT 28 out of the hole and run in with a capillary sleeve 32 as disclosed herein.

Figure 4:
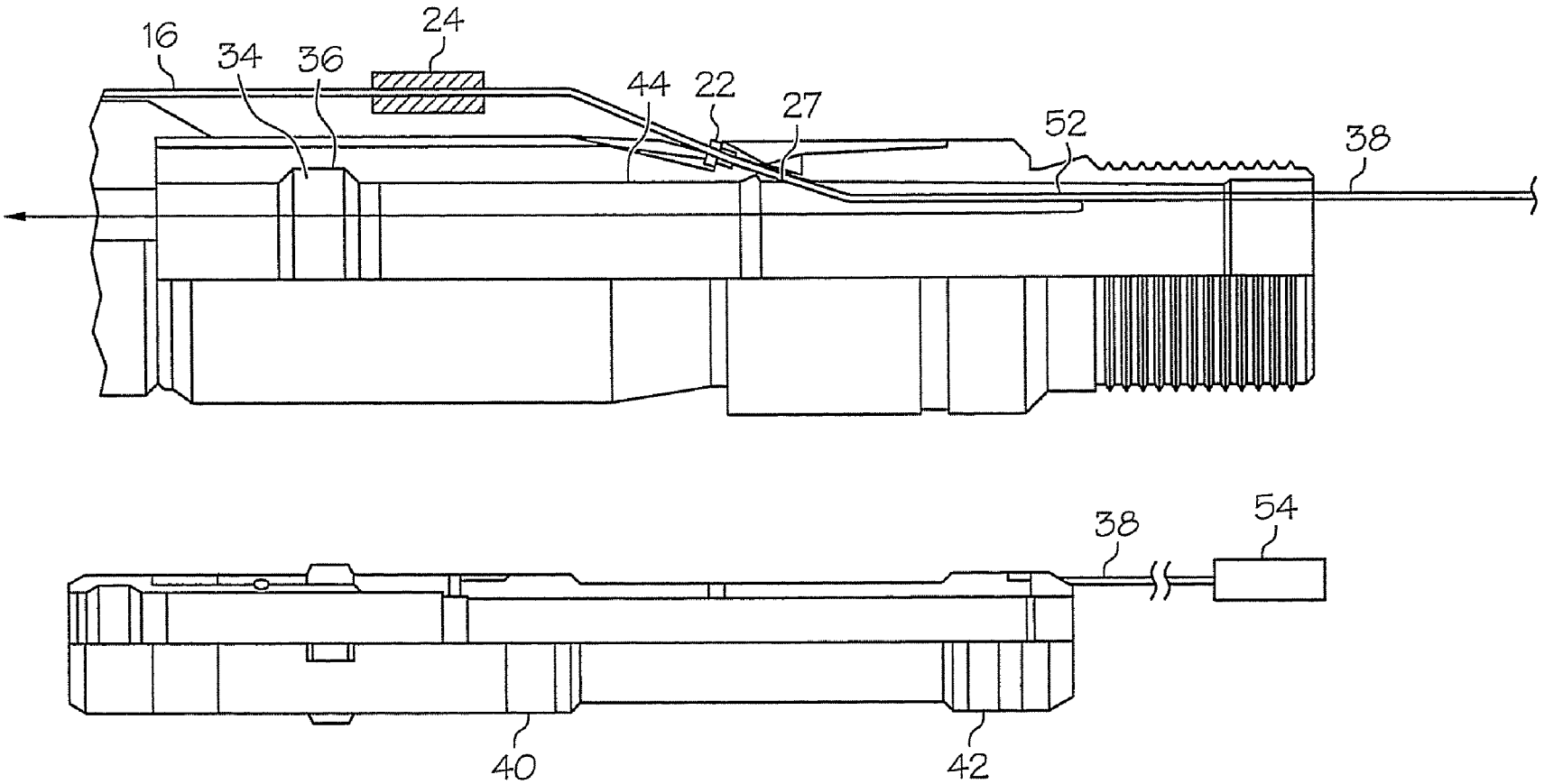
FIG. 4 is an enlarged view of the communication nipple of FIG. 1 with the capillary sleeve illustrated in place within the punctured communication nipple.

Referring to FIGS. 3 and 4, capillary sleeve 32 is a completely self-contained component that is run in the hole on a running tool (not shown) and then released after engagement with a profile 34 at an inside dimension of communication nipple 14 (see FIGS. 1 and 4). Profile 34 is engaged by one or more dogs 36 illustrated herein as four dogs, but other numbers are clearly substitutable. Dogs 36 and profile 34 are, in one embodiment, a snap-in/snap-out arrangement so that they are sufficiently engaged to support both the capillary sleeve 32 and a capillary tube 38 depending therefrom without further engagement to any structure extending through the TRSV and yet may be relatively easily disengaged by a retrieval tool (not shown) in the event that there is reason to remove the capillary sleeve 32 and dependent capillary tube 38. It is important to note here that because of the configuration of the capillary sleeve 32 that makes it wireline retrievable, any malfunction of the system (CIV, Capillary tube, etc.) can be repaired easily by retrieving it to the surface. It is also possible of course to simply replace these components of the system rather than repair them when pulled. The dogs 34 may also be configured to respond to a retrieval tool such that a snap out is not necessary but rather engagement of a retrieval tool causes the dogs to retract.

The capillary sleeve 32 further includes, an arrangement configured to seal the opened communication nipple to contain the chemical injection fluid. In the illustrated example, the capillary sleeve includes a pair of seals 40 and 42 supported on an outside dimension of the capillary sleeve 32 at positions calculated to create a seal with the inside dimension 44 of the communication nipple 14 while straddling the opening in the nipple 14. This configuration creates an annular sealed flow area for chemical injection fluid and thus a sealed pathway between the chemical injection line 16 and the capillary tube 38. Between the seals 40 and 42 is a recessed area 46 of the sleeve 32 that enlarges the annular flow area for enhanced flow characteristics to for example avoid a flow restriction in this area. Within the recessed area 46 is an inlet 48 to receive the chemical injection fluid and a conduit 50 within the sleeve 32 that is fluidly connected with the inlet 48 and to the capillary tube 38 to convey fluid thereto for subsequent transport to a remote location such as a perforation area of the wellbore (not shown). Capillary tube 38 is fluidly connected to the conduit 50 through a suitable connection such as a threaded connection 52 as illustrated in FIG. 4. In one embodiment, a redundant CIV 54 is included at a distal end 56 of capillary tube 38 to prevent wellbore fluid entering the capillary tube 38. Each of the CIVs illustrated in this system provide a fail safe operation as they will automatically shut if sufficient hydraulic pressure is not maintained upon them from the surface. In addition to the foregoing, the capillary sleeve is configured to provide the largest inside dimension practicable to improve the flow cross section of the tool. Because the componentry (cross section) of the capillary sleeve is kept to a minimum, the patency (flow area for recovery of hydrocarbons through the capillary sleeve) can be maximized.

In one embodiment, referring to FIG. 1, a Y-block 60 is employed so that the control line 62 for the TRSV can be used for the chemical injection as well. The line is split and thereafter runs both to the TRSV and to the communication nipple. This is an optional configuration however, and a dedicated line for the chemical injection will be employed in some applications. In an application where a Y-block is used, one configuration will have the TRSV open at about 7,000 psi and the CIVs at 10,000 psi. This will ensure that the TRSV will reliably open before and independently of the chemical injection valves.

It is to be understood that the distance between the location of the TRSV 12 and the communication nipple 14, and the distance between the nipple 14 and the capillary end 56 is largely limitless other than as practically limited simply by hydraulic friction. Each of these components may be spaced out as desired to ensure that chemical injection fluid is distributed as intended by the well operator. It is also possible to place multiple communication nipples 14 downhole that can individually be accessed to shorten the length of capillary tube 38 necessary to reach a target area with the chemical injection fluid.

A benefit of the system as disclosed herein is that the TRSV function is completely preserved using the disclosed configuration thereby not requiring a Wireline Retrievable Safety Valve (WRSV) or any other component extending through the TRSV. This of course reduces costs and maintains patency (flow area for recovery of hydrocarbons) in the flow area of the tubing string. Another benefit of this system is that there is no risk of producing hydrocarbons up the chemical injection prior to running a PCT and the capillary sleeve, which may not be necessary until later in the life of the well. The feature also provides benefits in thru tubing cement applications where cement is pumped through the ID of the tubing. During the initial completion of the well cement can be safely pumped through the ID of the communication nipple. The PCT will be able to punch through any cement (also scale and other solids that may deposit on the communication nipple) that remains on the wall of the communication nipple.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A chemical injection system comprising:

a tubing retrievable safety valve having a control line in operable communication therewith, the tubing retrievable safety valve being openable upon a threshold pressure in the control line, the control line including a Y-block;

a communication nipple in operable communication with the tubing retrievable safety valve and positioned relative to the tubing retrievable safety valve to be downhole of a flapper closure mechanism thereof when installed in a wellbore;

a chemical injection line extending from the Y-block and in fluid communication with the control line and the communication nipple;

a chemical injection valve fluidly communicated with the chemical injection line, the chemical injection valve being openable only in response to a pressure in the control line substantially higher than the threshold pressure; and a capillary sleeve receivable at the communication nipple and configured to sealingly convey fluid from the communication nipple to a remote location without affecting operation of the tubing retrievable safety valve.

2. The system as claimed in claim 1 further comprising a capillary tube in fluid communication with the capillary sleeve.

3. The system as claimed in claim 2 wherein the capillary tube further includes the chemical injection valve.

4. The system as claimed in claim 1 wherein the chemical injection line includes the chemical injection valve.

5. The system as claimed in claim 1 wherein the capillary sleeve includes a pair of seals arranged to straddle a fluid opening in the communication nipple.

6. The system as claimed in claim 5 wherein the capillary sleeve includes a recessed area between the pair of seals.

7. The system as claimed in claim 1 wherein the capillary sleeve includes one or more dogs actuable to engage the capillary sleeve with the communication nipple.

8. The system as claimed in claim 1 wherein the opening pressure for the tubing retrievable safety valve is 700 psi and the opening pressure for the chemical injection valve is 10000 psi.

9. A method for injecting a chemical to an area of a wellbore downhole of a tubing retrievable safety valve comprising:

running a puncture communication tool to a preinstalled communication nipple downhole of the flapper closure mechanism of the tubing retrievable safety valve;

creating an opening in the communication nipple with the puncture communication tool thereby fluidly communicating a chemical injection line with an inside dimension of the communication nipple;

sealing a capillary sleeve with the inside dimension of the communication nipple at the opening;

pressuring up on a control line to open the tubing retrievable safety valve and then pressuring the same control line to a higher pressure to open a chemical injection valve.

10. The method as claimed in claim 9 further comprising:

directing chemical injection fluid from the opening to a remote location through a capillary tube extending from the capillary sleeve.

11. The method as claimed in claim 9 wherein the method further comprises tripping the puncture communication tool out of the hole and running the capillary sleeve into the hole, past the tubing retrievable safety valve and releasing the capillary sleeve downhole of the tubing retrievable safety valve.

12. The method as claimed in claim 9 wherein pressuring is to a first threshold pressure of 7000 psi to open the tubing retrievable safety valve and a second higher threshold pressure of 10000 psi to open the chemical injection valve.

* * * * *